US005254661A

United States Patent [19]

Wilson

[11] Patent Number: 5,254,661

[45] Date of Patent: Oct. 19, 1993

[54] WATERPROOFING LAMINATE WITH INTEGRAL RELEASE COATING

[75] Inventors: John E. Wilson, Quakertown, Pa.; Arnold M. Rosenberg, Potomac, Dale P. Bentz, Frederick, both of Md.

[73] Assignee: W.R. Grace & Co.-Conn., New York, N.Y.

[21] Appl. No.: 787,851

[22] Filed: Nov. 5, 1991

[51] Int. Cl.[5] ..... B32B 3/00

[52] U.S. Cl. ..... 428/57; 428/141; 428/172; 428/219; 428/352; 428/451; 428/489; 428/518; 428/906

[58] Field of Search ..... 428/172, 141, 229, 451, 428/489, 518, 40, 57, 352, 906

[56] References Cited

U.S. PATENT DOCUMENTS

| | | | |
|---|---|---|---|
| 3,900,102 | 8/1975 | Hurst | 206/411 |
| 3,946,139 | 3/1976 | Bleyle et al. | 428/518 |
| 4,039,707 | 8/1977 | O'Malley | 428/40 |
| 4,172,830 | 10/1979 | Rosenberg et al. | 428/245 |
| 4,190,688 | 2/1980 | Traver et al. | 525/2 X |
| 4,215,160 | 7/1980 | Rosenberg et al. | 427/177 |
| 4,374,894 | 2/1983 | Antlfinger | 428/288 |
| 4,380,503 | 4/1983 | Koerner et al. . | |
| 4,386,135 | 5/1983 | Campbell et al. | 428/447 |
| 4,442,148 | 4/1984 | Stierli | 428/40 |
| 4,559,267 | 12/1985 | Freshwater et al. | 428/352 |
| 4,751,122 | 6/1988 | May | 428/41 |
| 4,755,409 | 7/1988 | Harkness | 428/40 |
| 5,082,704 | 1/1992 | Higgins | 428/40 |

OTHER PUBLICATIONS

"Information About Silcone Defoamers," Dow Corning Corporation, Form No. 22-030B-83 (2 pages).

"Standard Test Methods for Peel Adhesion of Pressure-Sensitive Tape at 180° Angle," ASTM, Designation: D 3330-83 (5 pages).

Technical Bulletin, "The KELGIN Series of Kelco algin products, highly refined for use in the paper industry, consisting of Kelgin HV, Kelgin MV, Kelgin LV, Kelgin XL, Kelgin RL", PDB #1 (4 pages).

"Syl-off systems, Coatings for premium performance", SYL-OFF System VII, Dow Corning Corporation, Form No. 22-993-84 (4 pages).

"SYL-OFF Systems, Coatings for Premium Performance", System IV, Dow Corning Corporation, Form No. 24-108A-89 (6 pages).

"Surface Active CoPolymers Could be the Most Cost--Effective Wetting Agents You Will Ever Use", Union Carbide Corporation, (20 pages).

"Moisture, grease, oxygen bounce off DARAN high barrier coatings", DARAN, Organic Chemicals Division, W.R. Grace & Co., Nov. 1982, (4 pages).

*Primary Examiner*—Paul J. Thibodeau
*Assistant Examiner*—H. Thi Le
*Attorney, Agent, or Firm*—Craig K. Leon; William L. Baker

[57] ABSTRACT

The present waterproofing laminates comprise a flexible sheet-like polymeric support having a first major side thereof coated with a release coating which is substantially non-adherent to bituminous compositions and having a second major side thereof coated with a flexible membrane layer of an adhesive bituminous composition, wherein said release coating can be removed with wet abrasion. These laminates can be formed into rolls for shipment without the need for a large release paper layer over the bituminous adhesive layer. The present invention also relates to a novel method of forming tight overlap seams between the adjacent layers of the present laminates. The method involves washing the first applied layer with a wet abrasion before applying an upper overlapping laminate.

14 Claims, 3 Drawing Sheets

WATERPROOFING LAMINATE WITH INTEGRAL RELEASE COATING

FIELD OF THE INVENTION

The present invention is directed to a novel waterproofing laminate which does not require the need for a separate, disposable, release sheet. Particularly, the present invention relates to improved bituminous waterproofing laminates. The present invention is also directed to novel methods of making and using the abovementioned waterproofing laminates.

BACKGROUND OF THE INVENTION

It is known that concrete surfaces and the like can be sealed in a waterproof manner by forming or applying thereon a membrane of a bituminous composition, such as asphalt, tar or pitch, which is substantially impermeable to moisture and water vapor. Preformed sheet-like materials useful for this purpose are well known. Examples of these materials are disclosed in U.S. Pat. Nos. 3,741,856, 3,853,682 and 3,900,102. These waterproofing materials have a laminate structure of a support sheet adjacent to a membrane of bituminous composition which has adhesive properties which renders it adherent to the support material and to the substructure, such as a concrete slab, to which it is applied. Laminate structures presently commercially available are supplied in the form of rolls which further comprise a flexible release sheet adjacent to the exposed surface of the bituminous membrane. This release sheet is a required component in the present mode of manufacture and serves, in the end product, to prevent the adhesive membrane from adhering to the sheet immediately adjacent thereto when in roll form. The release sheet does not form a part of the finally applied sheet-like structure which renders a substructure waterproof and, therefore, creates problems of removal and disposal at the job site.

Preformed flexible, sheet-like waterproofing material require the utilization of a release sheet, such as in the form of a siliconized paper, as an integral component in the presently known methods of formation. A release sheet capable of withstanding high temperatures is used as a forming surface upon which a hot semi-fluid bituminous composition, generally having a temperature of about 250° F., or greater, is applied. The composition must be cooled prior to superimposing a polymeric support on its free surface in order to minimize deterioration of the support. The resultant laminate structure, including the release sheet, is then formed into rolls for shipment. Alternately, when support sheets having a non-adherent free surface are used, the formed support-/membrane laminate is formed into rolls for storage and shipment by removing the laminate from the release sheet at the end of the manufacturing process.

Recently, waterproofing laminates have been developed which eliminate the need for a separate release sheet. U.S. Pat. No. 4,215,160 to Rosenberg and Gaidis describes a waterproofing laminate comprising a bituminous asphalt layer and a carrier sheet which eliminates the need for a release sheet by applying a release agent, specifically a poly(dimethylsiloxane) base release coating, to the backside of the carrier sheet prior to producing the product roll of laminate. Thus, a release agent-carrier-bituminous asphalt "jelly roll" is formed.

When laminates are applied, adjacent layers are typically overlapped. Unfortunately, when the laminate of the '160 patent is utilized the uppermost laminate's bituminous adhesive layer must be laid down over the release agent coated carrier layer of the already adhered sheet, onto which it cannot stick. Thus, the release agent at the overlapping seam must be scrubbed off with a suitable organic solvent. This practice is undesirable from health, safety and environmental viewpoints. As a result, this type of "paperless" waterproofing laminate has not met with success in the marketplace.

SUMMARY OF THE INVENTION

The present invention provides a novel preformed sheet-like waterproofing laminate structure of a flexible sheet-like membrane and an adhesive bituminous composition which does not require a separate disposable release sheet and, furthermore, incorporates a release agent which is readily removed by wet abrasion; thus, eliminating the shortcomings of prior laminates.

The present waterproofing laminates comprise a flexible sheet-like polymeric support having a first major side thereof coated with a release coating which is substantially non-adherent to bituminous compositions and having a second major side thereof coated with a flexible membrane layer of an adhesive bituminous composition, wherein said release coating can be removed with wet abrasion.

The present invention also relates to a novel method of manufacturing the abovementioned waterproofing laminates. The method comprises applying a flexible polymeric support, one major side of which is coated with a release coating which is non-adherent with respect to bituminous compositions and which can be removed by wet abrasion. The polymeric support is applied with its non-adherent major side in a face-to-face relationship with the forming surface. A hot bituminous composition having a temperature above the melting point of the polymeric support member is applied to the other major side of the polymeric support while simultaneously cooling for a time sufficient to cause the bituminous composition to become handleable. The present method does not require the utilization of heat resistance release sheet during the formation or packaging of the laminate structure.

The present invention also relates to a novel method of forming tight overlap seams between the adjacent layers of the present laminates. The method involves removing the first applied layer with a wet abrasion, drying the surface and then applying an upper overlapping laminate.

DETAILED DESCRIPTION OF THE INVENTION

Figure 1:
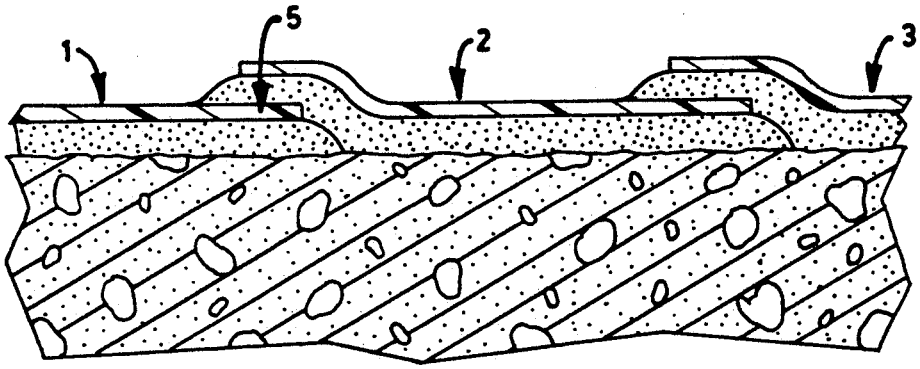
FIG. 1 shows, in cross section, the present laminate (1, 2 and 3) installed in overlapping fashion over a concrete surface 4. The first sheet 1 is applied, the release coating over the overlap region 5 is wiped clean by wet abrasion and the next sheet 2 is applied. These steps are repeated for subsequent sheets.
Figure 2:
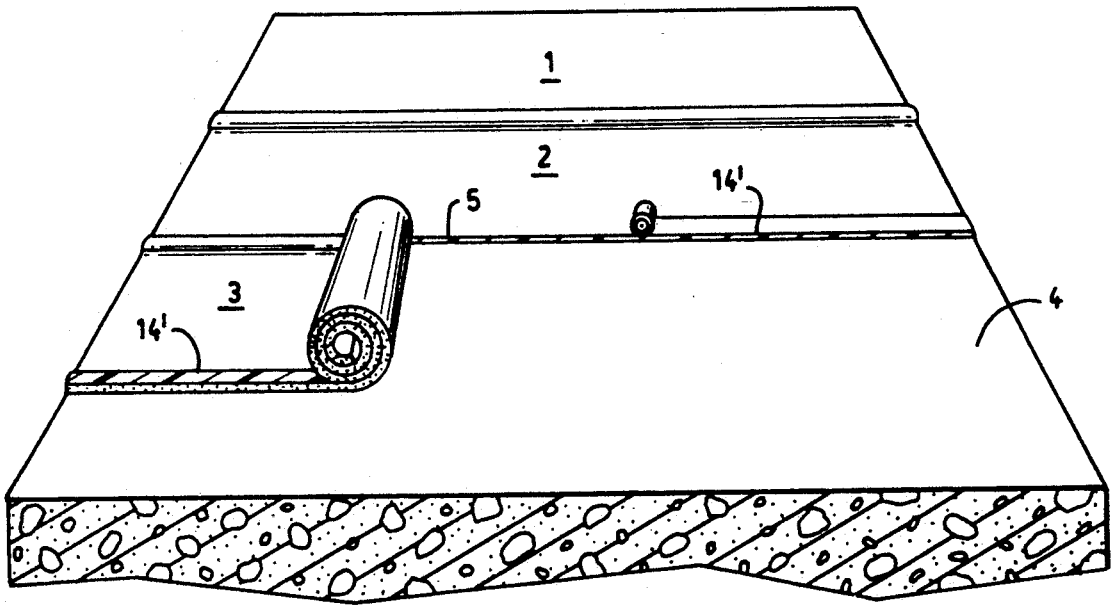
FIG. 2 shows a roll of the present laminate being applied. The product laminate 5 being applied, is similar to the product of FIG. 4 below. 14' is a thin strip of double-sided release paper along the overlap region 5. This long-edge mounted release strip is removed from the first applied laminate 2 before the next applied laminate 3 is positioned. Thus, only the end laps need to be water washed before overlap.

The waterproofing laminate of the present invention comprises a support sheet having superimposed on one major surface thereof a membrane of an adhesive bituminous composition. The opposite major surface of the support sheet is treated to be non-adherent to the bituminous membrane. The treatment must also be removable by wet abrasion.

The present method permits the utilization of a wide variety of sheet-like polymeric supports to form waterproofing laminate structures. Generally the support should be substantially impermeable to water and, based on the laminate structure's end use, capable of stretching with movement of the concrete or other material of the substrate to which it is ultimately applied.

The polymeric supports can be formed of natural rubber or of a synthetic organic polymer such as polyethylene, polypropylene or other polyolefin, a polyamide, a polyester, e.g., polyethlene terephthalate, a polyurethane, a polyvinyl halide, such as a polyvinyl chloride and copolymers thereof, such as a polyvinyl chloride and vinylidene chloride, a synthetic rubber, such as polychloroprene or butyl rubber, regenerated cellulose, cellulose, cellulose ethers or cellulose esters.

The supports can be films in the form of solid sheets, cellular films or woven and non-woven fabrics which are sufficiently non-porous to restrict the flow of the hot bituminous composition therethrough when applied.

Preferred support sheets are of poly(ethylene terephthalate) (PET) sheets, e.g. MYLAR and MELINEX brand sheets manufactured by E. I. Dupont denemours, Wilmington, Del, and ICI, London, England, respectively, and REVVAL brand MR-32058 sheet, manufactured by E. I. DuPont de Nemours, Co., Wilmington, Del. The preferred support typically at-e from about 0.5 to about 10 nails in thickness. Valeronl® brand oriented cross-laminated polyolefin film may also be used, however, due to its wetability, this film will require a wash coat as described below:

The support sheet may be treated with a wash coat to improve the wetability of the release coating. The wash should be applied to the outward face and may be applied to both faces of the support sheet. Suitable wash coats have the following desirable characteristics: good adhesion to polyethylene film; and, low surfactant content.

A preferred wash coat is DARAN 820 polyvinylidene chloride emulsion manufactured by W. R. Grace & Co.-Conn., Lexington, Mass. Support sheets which are precoated with a wash coat may also be used, e.g., Revval P86, manufactured by E. I. DuPont de Nemours, which has an acrylic wash coat on both sides.

The outside, i.e. non-bituminous, face of the support must be treated with a release coating. The release coating should be capable of making the surface substantially non-adherent to the bituminous material being used. The coating can be formed in any known manner at any time prior to application of the support to a forming surface as described hereinbelow. For example, the release coating can be formed on one of the major surfaces of the support by the deposition of an emulsion silicon composition which is cured by the aid of a catalyst and/or heat. The support can then be formed into rolls for storage and delivery to the site of formation of the waterproofing laminate structure. The support sheet can have any additional conventional features incorporated into its structure.

The release coating of the present invention must be non-adherent with respect to the bituminous compositions and must be readily removed by wet abrasion. As used herein the term "non-adherent" means that it prevents adhesion between two surfaces. Samples are deemed to be non-adherent if they yield a Keil release of less than 100 gm/in as determined by the method outlined herein below:

Keil Release Test for Rubberized Asphalt Laminate

Purpose:

This test procedure shall be the standard method for determining the release characteristic of rubberized asphalt laminate. It is an indication of the amount of force necessary to pull the silicone release paper from the mastic in the composite rubberized asphalt laminate.

Standard Test Method:

A. Equipment

1. Keil tester, with 0-500 gram scale, by Dow Corning (Model No. 2), or OHaus Model 8012.

2. Sample of rubberized asphalt laminate, 3" by 6" which has been conditioned for approximately 30 minutes in the lab.

Procedures:

1. Take a 3" by 6" sample of rubberized asphalt laminate to be tested and draw a line down the sample one inch from the center of the 3" side, on each side of the center (i.e., the lines should be ½" from the sides of the sample), or use a 2" wide templet.

2. Run a razor along each line or edge of the templet so that the silicone release paper is cut through to the mastic.

3. Using scotch tape, tape the sides of the rubberized asphalt laminate sample so that none of the mastic is visible (this it to prevent the mastic from adhering to the Keil Tester).

4. Peel back about I inch of the 2 inch wide portion of the release paper and fold the paper over on itself. Tape the exposed rubberized asphalt laminate with scotch tape.

5. Place the rubberized asphalt laminate sample in the Keil Tester, making sure that the 3" side containing the folded release paper and taped over rubberized asphalt laminate is at the bottom.

6. Fasten the silicone coated paper to the scale. Fasten the taped over rubberized asphalt laminate to the fixed clamp at the base of the Keil Tester.

7. Start the Keil tester and record the reading on the scale at one inch intervals as the paper releases from the mastic. Record only the force at 2, 3, 4 and 5 inches.

According to the present invention, the release coating must be a coating which is removable by wet abrasion. As used herein the term "wet abrasion" means that the release coating can be rubbed off by hand with a water wet/damp cloth, rag, plastic pot scrubber, brush or towel. Preferably this type of release coating is a water-based silicone emulsion, most preferably these emulsions are fast curing. Silicone emulsions suitable for use in the present invention are described in U.S. Pat. No. 4,190,688 to Traver et al. incorporated herein by reference. Suitable commercially available emulsion coatings include the SYL-OFF ® System IV family of reactive silicone emulsions, the SYL-OFF ® System VII family of emulsions containing reactive organofunctional silixone (both manufactured by Dow Corning Corp, Midland, Mich.) and water dilutable emulsions of reactive silicone polymers like SM 2145/SM 2146c Silicone Paper Release (manufactured by General Electric company, Waterford, N.Y.). A preferred embodiment of the present invention has the following formula:

| | |
|---|---|
| Deionized water: | 54.84% (wt.) |
| 1.5% Sodium Alginate Solution: (Kelgin-MV -medium high viscosity, mfg. by Kelco Algin, Chicago, IL) | 28.92% |
| Polyalkylene oxide modified dimethyl polysiloxane surfactant: (Silwet L-7607, mfg. by Union Carbide Corp., Danbury, CT) | 0.12% |
| Silicone catalyst emulsion X-27741: (Mfg. by Dow Corning, Midland, MI) | 8.05% |
| Silicone polymer emulsion X-27740: (Mfg. by Dow Corning, Midland, MI) | 8.05% |
| Antifoam Emulsion (Dow Corning 1430 Antifoam) (Mfg. by Dow Corning, Midland, MI) | 0.02% |
| | Σ100.00% |

The above formula, at from 1% to 101. solids, is applied by either a rod coater or an air knife coater. An air knife coater is used to apply anywhere from 1.4 to 60 grams per square meter (wet) or per square meter to 4 grams per square meter after drying. (Preferably 0.4 grams per square meter to 1.6 grams per square meter after drying). Dry coating weight can be measured by X-Ray flourescence or other suitable methods. Other coating methods can be used. When using Meyer rods, suitable coatings can be achieved from a 3–7% silicone solids bath containing 1–2% carboxy methyl cellulose or 0.25–.5% sodium alginate. A #16 or #18 Meyer rod is typically used. When using the Direct Gravure method, suitable coatings can be achieved from a 7–15% silicone solids bath with and without thickener or extender, depending on the base sheet. Good results can be obtained using 80–150 line/inch gravure cylinder. When using the Offset Gravure methods, suitable coatings can be achieved from a 20–40% silicone solids bath without thickener. When using a size press, suitable coatings can be achieved from a 10–20% silicone solids bath without thickener or extender. Horizontal and inclined configurations are suitable, but vertical application is not recommended. Reverse roll coating method can also be used.

The bituminous compositions of the present invention can be any tar, asphalt, pitch or the like which is adhesive to and will render waterproof the contemplated substructure on which the final laminate product is to be used without the aid of heat or additional bonding agents at the site of application.

Thus, for application to surfaces of concrete, which are comparatively rough and dusty, the layer of adhesive composition must be at least about 0.010 to 0.2 inch (0.063 to 0.5 cm), the thicker the layer of adhesive composition the better the waterproofing effect, but in general, a layer of about 0.03 to 0.10 inch (0.08 to 0.25 cm) which is suitable.

Bituminous adhesive compositions are generally formed of natural or synthetic rubber, virgin or reclaimed, blended into bitumen to provide a smooth mix. The ratio by weight of bitumen to rubber is usually greater than about 75:25 with ratios of from about 80:20 to 95:5 being preferred. The compositions should be a non-solvent type which, preferably, is semi-fluid at temperatures of from about 125° C., and capable of application onto the support sheet as a coating. The resultant product is a flexible, pressure sensitive membrane having cold flow properties.

The resulting waterproofing laminate is preferably manufactured according to the method described in U.S. Pat. Nos. 4,992,334; 5,028,487 and 4,442,148, all incorporated herein by reference; however, a support sheet with a preapplied release coat is utilized and release paper is eliminated. The formed sheet-like waterproofing laminate structure is taken up as a roll with the non-adherent side of the support film in facing relationship with the free surface of the bituminous composition. Rolls of desired lengths of material are cut away from the remainder of the laminate structure to yield a free surface of the continuous belt, ready for additional formation of laminate structure. For vertical applications, the product can be rolled with the adhesive face on the inside. For horizontal applications, the product can be rolled with the adhesive face on the outside; thus, a small sheet of release paper is wrapped around the exposed adhesive to facilitate handling.

As noted above, the novel waterproofing laminates provide a waterproof barrier over a surface, particularly a concrete surface, by unrolling a desired length of material, applying the exposed bituminous layer to said surface, removing the silicone coating over edges to be overlapped and forming overlap seals as needed in order to form a continuous membrane over the whole surface.

The following example is given for illustrative purposes only and is not meant to limit the invention except as set forth by the claims hereinbelow. All parts and percentages are by weight except where otherwise indicated.

EXAMPLE I

Method of Preparing Release Coating

A) A sodium alginate solution is prepared by adding 1576 pounds of deionized water to a large Cowles mixer. The Cowles mixer is then turned on to the slowest speed setting. 24 pounds of sodium alginate (Kelgin MV) is slowly sifted into the vortex of the water. The Cowles blade speed is increased as thickening occurs to keep the liquid surface moving rapidly. The solutions is mixed 45 minutes or longer until the solution is smooth and free from lumps. The solutions is transferred to clean drums for storage. The solution is allowed to stand overnight before using. The Brookfield viscosity should be 400 to 1500 centipose using a #3 spindle at 60

RPM at 72° F. to 76° F. The sample must be at least 12 hours old before testing the viscosity.

Figure 3:
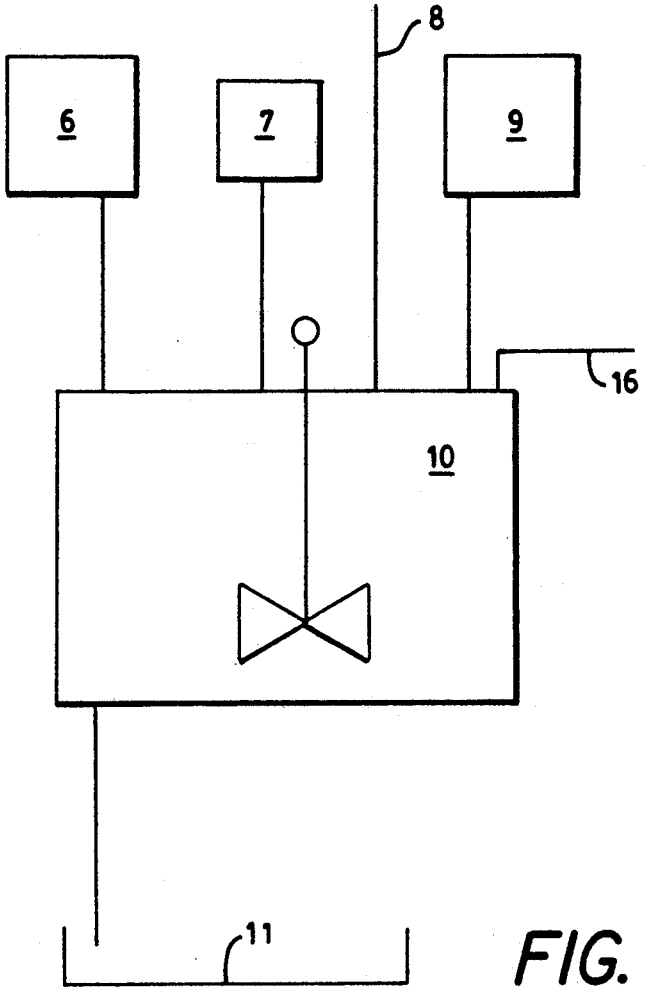
FIG. 3 is a diagram of the preferred mixing scheme for preparing the present release coating, where 6 is the silicone emulsion tank or container, 7 is the aqueous thickener solution tank or container, 8 is the water inlet line, 9 is the silicone catalyst emulsion tank or container, 10 is the mixing tank (preferably of minimum size) and 11 is the coating pan of minimized size and with no recycle, unless air knife coating equipment is used wherein a blow-off return line 16 is required.
Figure 4:
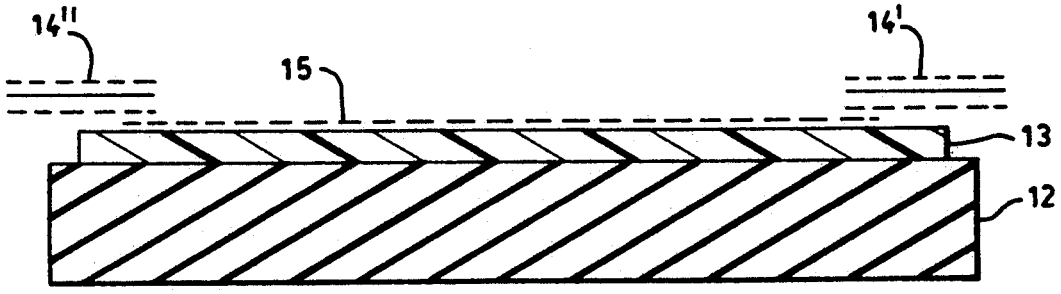
FIG. 4 is a cross-sectional representation of the preferred waterproofing laminate product, where 12 is a rubberized asphalt layer 36 inch wide, 13 is PET carrier film 35½ inch wide, 14' and 14" are 6 inch double-sided release strips along the edge and 15 is the wet abrasion removable silicone release coating. (NOTE: The edge mounted release strips are utilized because it is believed that it will be easier for the applicator to only have to wash the "end" laps. Furthermore, a single release stop product, as in FIG. 2 above, is most preferred.)

B) The coating is prepared in mixing equipment similar to the diagram in FIG. 3. To the mix tank, 250 pounds of deionized water is added. 110 pounds of sodium alginate solution prepared according to step (A) above is then added. The mixture is mixed together without generating foam. 269 grams of silwet L-7607 wetting agent is added to a 5 gallon plastic pail containing 10 pounds deionized water. The mixture is thoroughly mixed together with a small hand held mixer then this mixture is added to the large mixing tank containing the previously added ingredients. 40.9 pounds of Dow corning X-27741 emulsion is added to the large mix tank. Mixing is continued without generating foam. 40.9 pounds Dow Corning X-27740 emulsion is added to the large mix tank. The solution is mixed without generating foam. 58 grams of Dow Corning DC-31 antifoam emulsion is added to a plastic pail containing 10 pounds deionized water. They are thoroughly mixed together with a small hand held mixer then this mixture is added to the large mixing tank containing the previously added ingredients. The final addition to the large mix tank is 38.2 pounds deionized water to bring the total tank contents to 500 pounds net weight. The final coating formula is 7.0% solids and has a Brookfield viscosity of 30 to 150 centipose.

C) The above coating is gravity fed to the coating equipment coating pan as required to keep the coating pan full.

D) The coating is applied to the support film using an air knife coater as shown in FIG. 3. The amount of wet coating applied to the support film is such that the final dry release coating weight is 0.1 grams per square meter to 4 grams per square meter and preferably 0.4 grams per square meter to 1.6 grams per square meter. The amount of wet coating applied to the support film is controlled by 1) the viscosity of the coating solution, 2) the speed and direction of the applicator roll, 3) the speed of the web through the coating equipment, 4) the air knife air pressure, 5) the angle of the air knife air jet to the support film, 6) the width of the air knife slot, and 7) the distance the air knife is from the support film.

E) After the support film is coated the web passes through a hot air oven to dry the coating and to cure the silicone release coating without causing the support film to distort from reaching too high a temperature. For this process, the oven had five separate heating zones. The first to zones were set at 300° F. and the last three zones were set at 325° F. The total time in the oven is 20 seconds.

I claim:

1. A waterproofing laminate, comprising: a flexible sheet-like polymeric support having a first major side thereof coated with a release coating which is substantially non-adherent to bituminous compositions and having a second major side thereof coated with a flexible membrane layer of an adhesive bituminous composition, wherein said release coating is applied as a water-based emulsion whereby said release coating, when dried, is removable from said first major side of said support layer by wet abrasion.

2. A waterproofing laminate according to claim 1 wherein the release coating is a water-based silicone emulsion.

3. A waterproofing laminate according to claim 1 wherein said water-based emulsion of the release coating comprises a surfactant.

4. A waterproofing laminate according to claim 3 wherein the water-based silicone emulsion contains reactive organofunctional siloxane polymers.

5. A waterproofing laminate according to claim 4 wherein the release coating is applied at a coating weight of from about 0.1 grams to about 4.0 grams per square meter after drying.

6. A waterproofing laminate according to claim 5 wherein the polymeric support is in the form of solid sheets, cellular films or woven and non-woven fabrics which are sufficiently non-porous to restrict the flow of a hot bituminous composition when applied thereon.

7. A waterproofing laminate according to claim 6 wherein the polymeric support is poly(ethylene terephthalate).

8. A waterproofing laminate according to claim 7 wherein the bituminous composition is in the form of a membrane comprising tar, asphalt, pitch, and rubber.

9. A waterproofing laminate according to claim 6 wherein the polymeric support is comprised of a polyolefin film and further comprises a wash coat to improve wetability of the release coating.

10. A waterproofing laminate according to claim 9 wherein said wash coating is a polyvinylidene chloride emulsion.

11. A waterproofing laminate according to claim 6 wherein the water-based silicone emulsion contains water, a sodium alginate solution, polyalkylene oxide modified dimethyl polysiloxane surfactant, silicone catalyst emulsion, silicone polymer emulsion and antifoam emulsion.

12. A waterproofed structure comprising:

a structure having at least two adjacent waterproofing laminates thereupon and having an overlap seam between adjacent waterproofing laminates, wherein the waterproofing laminates comprise a flexible sheet-like polymeric support having a first major side thereof coated with a release coating which is applied as a water-based emulsion whereby said release coating, when dried, is substantially non-adherent to bituminous compositions, said polymeric support further having a second major side thereof coated with a flexible membrane layer of an adhesive bituminous composition, wherein said release coating can be removed with wet abrasion and wherein the release coating of the first applied laminate layer on the portion of the laminate which is to be overlapped is removed by wet abrasion before the second applied, overlapping, laminate layer is applied.

13. The waterproofed structure of claim 12 wherein said structure, upon which said laminates are located, comprises concrete.

14. The waterproofed structure of claim 13 wherein said water-based emulsion comprises silicone.

* * * * *